US005221295A

United States Patent [19]

Zador

[11] Patent Number: 5,221,295

[45] Date of Patent: Jun. 22, 1993

[54] GRINDING AID FORMULATIONS

[75] Inventor: Eugene Zador, Ballston Lake, N.Y.

[73] Assignee: Norton Company, Worcester, Mass.

[21] Appl. No.: 880,768

[22] Filed: May 11, 1992

[51] Int. Cl.[5] ..... C09K 3/14

[52] U.S. Cl. ..... 51/298; 51/306

[58] Field of Search ..... 51/298, 306

[56] References Cited

U.S. PATENT DOCUMENTS

| | | | |
|---|---|---|---|
| 3,256,076 | 6/1966 | Duwell et al. | 51/295 |
| 3,541,739 | 11/1970 | Byron et al. | 51/295 |
| 3,676,092 | 7/1972 | Buell | 51/295 |
| 3,784,365 | 1/1974 | Caserta et al. | 51/298 |
| 3,806,956 | 4/1974 | Supkis et al. | 51/298 |
| 3,868,232 | 2/1975 | Sioui et al. | 51/298 |
| 3,997,302 | 12/1976 | Supkis | 51/295 |
| 4,537,604 | 8/1985 | Dawson | 51/298 |
| 5,051,112 | 9/1991 | Keshavan et al. | 51/298 |

FOREIGN PATENT DOCUMENTS

0433031A1 6/1991 European Pat. Off. .

*Primary Examiner*—Mark L. Bell
*Assistant Examiner*—Willie J. Thompson
*Attorney, Agent, or Firm*—David Bennett

[57] ABSTRACT

Coated abrasives provided with a coating comprising a grinding aid and a binder resin are particularly effective when the grinding aid is an halogenated hydrocarbon.

13 Claims, No Drawings

GRINDING AID FORMULATIONS

BACKGROUND OF INVENTION

This invention relates to coated abrasives and more specifically to grinding aid formulations that give particularly advantageous results when used with coated abrasive products.

Typically a coated abrasive product is formed by depositing an abrasive grit on a substrate, which is usually a flat sheet, belt, disc or the like, and adhering the grit to the surface using a "maker" coat. Over the top of this layer, a further layer called a "size" coat is applied to enhance the adhesion of the grit to the substrate. Occasionally it is desirable to add a further coat on top of the size coat incorporating a grinding aid to improve the grinding performance when the product is in use. This coat is commonly called the "supersize" coat and it is understood that "super-" here connotes location rather than quality.

The various layers are usually based on a polymeric binder material that, upon curing, forms a continuous film. This polymer can be selected from phenolic resins, radiation curable polymers, epoxy resins, polyurethanes and the like. The most common binder used is a phenolic resin. Frequently the same basic resin is used for all the layers since this ensures a degree of compatibility between contiguous layers.

The use of a coated abrasive product to grind a metal substrate results in the generation of a good deal of heat. As a result the grits may become dulled, the workpiece may be burned or the grits can be dislodged from the coated abrasive. Sometimes all three negative consequences ensue. It has been found that certain materials, called grinding aids, enhance the ease with which the cutting action occurs and hence prolong the cutting life of the coated abrasive. The reason for this improvement is not fully understood. Various theories have been proposed to explain the observation postulating chemical interactions or cooler cutting conditions. Whatever the truth of the matter, this enhancement is usually found only with relatively coarse grit sizes of about 120 and coarser since, with finer grits, the grinding aid seems to have little effect. This may be because there is little space between the grits to accumulate and the layer stays essentially completely on the surface. As a result it may be removed before it has a chance to have an effect. Regardless of the theory involved, the use of grinding aids is usually confined to relatively coarse grit products.

Various materials have been proposed as grinding aids but the one that is most widely used commercially and has proved the standard for efficiency has been $KBF_4$ or potassium fluoroborate.

The grinding aid is usually applied in a supersize layer rather than in a size layer. This is because a greater loading of the grinding aid is possible if the binder component of the composition does not also have the function of enhancing the bonding of the grits to the substrate, as is the primary function of the binder in a size coat. There is however no reason that the grinding aid could not be present in both the size and supersize layers. There are however indications that grinding aids in a size coat which is overlain with a supersize coat may contribute little to any observed improvement.

The present invention is based on the discovery of particularly advantageous grinding aid formulations. The use of these formulations, whether as supersizes, as sizes or as both, permits the realization of significant advantages over the formulations presently known.

DESCRIPTION OF THE INVENTION

The present invention provides a grinding aid formulation comprising a water-insoluble, halogenated hydrocarbon, having a halogen content of at least 50 wt. %, which is thermally stable up to about 400° C. but is thermally unstable below about 600° C., and a polymeric binder curing to a coherent film, the hydrocarbon and the binder being selected such that the resulting formulation has a Brookfield viscosity (measured at 80° F., using a #3 spindle at 12 rpm and referred to hereafter simply as the "viscosity"), of from 1000 to 12000 cps, and preferably from about 2000 to about 6000 cps, and a grinding quotient of at least 1.5.

It is important to recognize that the coating process imposes certain viscosity limitations. The formulation must not be so fluid that a sufficient quantity cannot be deposited in a single pass nor so viscous that coating evenly becomes impossible. Generally the viscosity limitations of from 1000 to 12000 cps define the outer limits of what is practicable, with the 2000 to 6000 cps range being the range that can most easily be accomodated using conventional equipment. It is also preferred to have a shear response index as close as possible to that for Newtonian behavior as possible and in any event less than about 2.5. The shear response index is found by dividing the viscosity found using the #3 spindle at 6 rpm with that obtained at 30 rpm using the same spindle. This is done by careful selection of the binder and by the use of additives such as dispersion aids, surfactants and anti-foaming agents.

This viscosity requirement will therefore play a part in the selection of the appropriate amounts of the components. In general the rule is that the largest amount of the grinding aid should be included providing that: 1) the viscosity is within the permissible range; 2) the binder is still capable of forming a coherent film on curing; and 3) the dispersion is still stable.

The amount of the grinding aid in the preferred supersize formulations of the invention can vary widely but in general it is often preferred that it is above about 50% of the combined solids weight of the binder and grinding aid. Frequently the grinding aid represents from about 60 to 80% of the combined grinding aid/-binder solids weight and within this range the greater the amount, consistent with maintaining a viscosity within the desired range, the better. It is found in addition that higher loadings lead to a duller appearance for the abrasive product and this is generally preferred by the customers.

In the context of this specification, the term "halogenated hydrocarbon" is intended to indicate that the compound comprises an essentially hydrocarbon structure in which at least some, (and perhaps all), of the hydrogen atoms have been replaced by halogen. The term "halogen" in "halogenated hydrocarbon" shall be limited to chlorine and bromine. This does not necessarily rule out the presence of other halogens but such elements are not included in calculating the percentage halogen in the halogenated hydrocarbon. The grinding aid component is described as an halogenated hydrocarbon but it is understood that the term does not preclude the presence of other atoms than halogen, hydrogen and carbon as linking or pendant groups in an essentially halogenated hydrocarbon structure. Thus the compound may comprise an oxygen atom for example in the form of an ether linkage, or a carboxylic, anhydride or hydroxyl group. It could also comprise a nitrogen atom for example in the form of a linking imide or pendant amine group. The compound may also be a halogen-containing polymer such as polybromostyrene or a copolymer of vinylidene chloride with a high temperature component such as acrylonitrile and a flexibilizing component such as an acrylate monomer. In this latter case the polymer could also function as the grinding aid itself if its thermal properties meets the requirements set forth in this specification.

The grinding aid used in the formulation of the invention is also described as thermally stable up to about 400° C., but begins to lose weight through thermal decomposition before a temperature of about 600° C. A compound is considered to be thermally stable at a specific temperature if, when heated to that temperature, it does not lose more than 50% of its weight. Thus the compounds useful in the formulations of the invention begin to evolve significant quantities of halogen-containing decomposition products, (which often, but not necessarily, coincides with the melting point of such compounds), above about 400° C. and below about 600° C. Preferred compounds lose at least about half their weight when heated at a temperature of about 600° C. The significance of this range is that evidence indicates that temperatures in this range are experienced at the workpiece surface during grinding. The intent therefore is to ensure that, during use, the grinding aid will indeed be effective to enhance grinding performance.

A significant advantageous characteristic of the formulations of the present invention is the "grinding index". This term is defined to represent an accurate "real-world" indication of the performance of the formulations of the invention and is based on the comparative grinding performance, in a standard grinding operation, of a coated abrasive product having a formulation according to the invention applied as a supersize, with that of the same product without the supersize formulation.

The standard grinding operation used as the basis for the comparison is the abrasion of a 304 Stainless Steel bar using a coated abrasive belt moving at 3000 sfpm. The test piece bar, ($\frac{1}{2}''\times2\frac{1}{2}''\times9\frac{3}{4}''$), is held horizontally and forced against the belt, (backed by a rubber contact wheel), with a pressure of 15 lb. The test piece speed is 7 sfpm. Grinding is carried out for two minute periods with a cool-off period before the next two minute period of grinding until a total of twenty minutes of grinding has been achieved.

The coated abrasive base used in the evaluation of the grinding aid formulations as described herein is a conventional substrate with maker and size coats and abrasive grits of the same nature and grit size for each comparison forming the basis of the calculation of the grinding index.

The grinding index of the grinding aid formulation is assessed after 20 minutes. It is however instructive to compare the grinding indices at intermediate times to show the steady and continuing effectiveness of the formulations of the invention. The assessment involves comparing the cumulative amount of metal removed from the metal bar by belts having a supersize formulation according to the invention with the amount removed by a similar belt without a supersize layer. The ratio of the two is the grinding index of the formulation. Belts with a supersize according to the invention grind at least 150% better, (that is, have a grinding index of at least 1.5), and often as much as 200% or more than the same belt without a supersize formulation.

The halogenated hydrocarbon used in the formulations according to the invention is a solid at room temperature and up to at least about 80° C. and preferably at least about 100° C. It contains at least about 50 wt. %, and preferably from about 60 to about 90 wt. %, and most preferably from about 65 to about 85 wt. % of halogen. Typical halogenated hydrocarbons useful in the present invention include: Chlorez 700 and 760, (chlorinated $C_{20}$–$C_{30}$ paraffin waxes with about 70 wt. % of chlorine, available from Dover Chemical Co. under the Chlorez trade name: the 700 and 760 designations denote different melting points, (100° C. and 160° C. respectively), of combinations of compounds from within this group); Dechlorane Plus, (an halogenated cycloaliphatic hydrocarbon with a molecular weight of about 650 and a chlorine content of about 65 wt. %); pentabromotoluene, (82 wt. % bromine); decabromodiphenyl oxide, (83 wt. % halogen); hexabromocyclododecane, (76 wt. % halogen); ethylene bis(tetrabromophthalimide), (67 wt. % halogen); chlorendic anhydride, (57 wt. % chlorine); and similar materials. Good results are obtained with chlorinated and brominated hydrocarbons but there is a slight preference for the chlorinated products.

The preferred halogenated hydrocarbons are often polymers, (for the purposes of this specification these are considered to be compounds with repeating units and a molecular weight of more than about 1,000 as opposed to oligomers which are often described as low molecular weight polymers with molecular weights below about 1,000). Such products tend to stay stable up to the desired temperature range and release halogen halides at an acceptable rate upon decomposition.

The binder is chosen with the specific halogenated hydrocarbon in mind. Reaction with the grinding aid need not necessarily be disadvantageous but this should not affect the shelf life of the formulation. There should be as little shear thinning as possible so as to ensure good flow control when in use. It is necessary that the viscosity be such that the formulation is coatable at operating temperatures below those at which the grinding aid begins to decompose. In addition it should preferably have sufficient binding capacity that it can be film forming upon curing at a high grinding aid loading. Suitable binders can include phenolic resins, epoxy resin dispersions, low molecular weight melamine and phenolic/melamine oligomer mixtures, or radiation curable resins such as those described in U.S. Pat. Nos. 4,047,903; 4,588,419; 4,773,920; 4,903,440; and 5,055,113. It is also possible to use as a binder, a halogen-containing polymer such as a vinylidene chloride polymer or copolymer. Indeed this can confer added benefits in terms of its available halogen content. Examples of such polymers include products commercially available under the trade names: Geon X80 (copolymer of vinylidene chloride and acrylic monomers); Geon 151 (PVC); and Daran SL-112 (copolymer of vinylidene fluoride, acrylonitrile and acrylic monomers).

One very important function performed by the binder is to limit the amount of gases given off during grinding. This surprising effect is very significant because the off-gases can comprise halogen gases or hydrogen halides, both of which are extremely acrid and unpleasant. It is found for example that using Chlorez-700 in an aqueous emulsion painted on to the abrasive surface as described in U.S. Pat. No. 3,676,092, the hydrogen chloride gas concentration above the workpiece during use was an unacceptable 1.00 mg/m$^3$. If however the same additive was applied in equivalent amounts except that it was applied in a mixture with an epoxy resin as described in Example 3 below, the hydrogen chloride level detected was reduced to one quarter the level detected when the grinding aid was used in aqueous emulsion. Improvements of this degree are considered as very significant and unexpected based on the experience in the art.

Another significant advantage of the formulations of the invention is that they often prolong the advantages that flow from the use of the grinding aid. Typically a grinding aid such as $KBF_4$ shows a big initial advantage but this fades rapidly after the initial cut. The formulations of the invention keep on improving the cut for much longer as the Examples below will demonstrate; almost as if the grinding aid were in sustained release form.

Another unexpected advantage of the use of the binding agent in the formulations of the invention is that the tendency of the grinding aid to smear the surface of the workpiece is much reduced. Without the binder the extent to which the grinding aid decomposes in the vicinity of the point of grinding is quite large. It is observed however that using a binder the exposure of the grinding aid to the grinding conditions is more restricted such that extensive and excessive decomposition of the grinding aid is avoided. In practice this means that the release is in a more controlled fashion and the effectiveness is longer lasting.

The formulation can also comprise other components such as colorants, bubble breakers, dispersants and the like.

DESCRIPTION OF THE PREFERRED EMBODIMENTS

The invention is further described with reference to the following specific Examples which are intended as illustrations and not to imply any necessary limitations to the essential scope of the invention.

The comparisons set forth in the following Examples were all performed using as the abrasive substrate a sateen woven, 7 ounce fabric, polyester that had been backfilled, treated with first and second coatings of an abrasive over a phenolic maker coat, followed by a phenolic size coat. Except in the case of the comparative evaluation, this was then treated with the specified supersize coating. The grit size was usually 36 except where otherwise stated. The grit used was either seeded sol-gel alumina or fused alumina/zirconia. In all cases involving comparisons, the same substrate was used under the grinding aid formulation.

EXAMPLE 1 (COMPARATIVE)

This Example shows the grinding performance of the un-supersized coated abrasive against which the supersize formulations of the invention described in the subsequent Examples are measured. It will clearly appear from these other Examples that the performance improvement from the use of the formulations of the invention is very much greater than 50% over that of the un-supersized products.

In addition to the performance of the un-supersized product, the results set forth below in Table 1 set out the results obtained with a conventional supersize. potassium fluoroborate, in a phenolic/melamine (5:3 weight ratio) resin binder. The phenolic component which represents 10.8 % of the formulation weight, was V-1402, available from Oxychem Corp.; and the melamine component, which represents 6.2 % of the formulation weight, was BTLM-817, available from Occidental Chemical Corp. The solids proportions of grinding aid to binder resin in the formulation was 3:1 and the formulation additionally contained water and dispersants, (Daxed 11 from W. R. Grace Co., Nalco 2311 from Nalco Corp. and a red dye, E-5260, from ICI). The "viscosity" of the formulation, as the term is used herein, was 4000 cps. More broadly, the viscosity at 6 rpm was 5,000 cps and at 30 rpm was 3,200. Thus the shear response index was 1.56.

The formulation composition, (in grams), of the control formulation, (containing $KBF_4$), was as follows:

| | |
|---|---|
| Water | 150 |
| Dexad 11 | 50 |
| V-1402 | 130 |
| BTLM-817 | 75 |
| E-5260 | 40 |
| Nalco 2311 | 10 |
| $KBF_4$ | 750 |

The grinding results for each on the standard test described above were as follows:

TABLE

| | Cumulative Metal Cut (grams) | | | | |
|---|---|---|---|---|---|
| Supersize | 4 min | 8 min | 12 min | 16 min | 20 min |
| NONE | 29 | 42 | 53 | 66 | 78 |
| $KBF_4$ | 72 | 102 | 121 | 139 | 156 |

EXAMPLE 2

This Example describes three formulations, A,B, and C), were made using the same grinding aid, (Chlorez 760 - described above), and with two different binders, (the phenolic/melamine resin mixture from Example 1, two iterations; and one run using a dispersion of a thermosetting epoxy/melamine resin binder), in roughly equivalent weight proportions. As can be seen from the data in Table 2, the change in the binder made little difference to the effectiveness of the grinding aid.

The formulations were evaluated as supersizes over 36 grit seeded sol-gel alumina on a fabric belt using phenolic maker and size coats. The products and their method of testing were identical except for the nature of the grinding aid. In Table 1 below, the products tested are identified by the grinding aid they contain.

TABLE 2

| | Gm. of Metal Cut (after mins.) | | | | | |
|---|---|---|---|---|---|---|
| Binder | 4 | 8 | 12 | 16 | 20 | G.I. |
| Phenolic/Melamine | 99 | 147 | 174 | 192 | 211 | 2.71 |
| Phenolic/Melamine (1) | 104 | 151 | 175 | 191 | 206 | 2.64 |
| Epoxy/Novolac (2) | 103 | 145 | 168 | 185 | 203 | 2.60 |
| No Supersize (Ex. 1) | 29 | 42 | 53 | 66 | 78 | |

"G.I." is the grinding index cumulated over the full run.

(1) This was an iteration of the first run on an identical, freshly prepared belt. The phenolic/melamine binder was that used in Example 1.

(2) The epoxy/novolac formulation comprised 75% of the grinding aid, (based on the combined weight of the binder and resin). The viscosity of the formulation was 3200 cps. In addition to the epoxy/novolac resin, (CMD-35201 available from Interez Co., with a 2-methyl imidazole cross linker), the formulation contained minor quantities of dispersants, (sodium xylene sulfonate and Dowfax 2A1) to facilitate the production of a coatable dispersion.

As can be seen from the above, Chlorez 760 performed very comparably with either a phenolic or an epoxy/novolac resin binder formulation. Moreover the effectiveness was several times better than the un-supersized product illustrated in Example 1 and significantly better than the conventional $KBF_4$.

EXAMPLE 3

This Example illustrates the advantages of the use of another grinding aid, Chlorez 700, which is similar to the Chlorez 760 described above but with a lower molecular weight.

The grinding aid was applied in four separate formulations: two using the same phenolic/melamine resin binder described in Example 1 and two using the epoxy binder described in Example 2. The results are set forth in Table 3 below.

TABLE 3

| Binder | Metal Cut in Mins. indicated (gms) 4 | 8 | 12 | 16 | 20 | G.I. |
|---|---|---|---|---|---|---|
| Phenolic/Melamine | 107 | 175 | 214 | 239 | 260 | 3.33 |
| Phenolic/Melamine (1) | 105 | 168 | 200 | 221 | 240 | 3.08 |
| Epoxy/Novolac | 72 | 93 | 110 | 125 | 139 | 1.78 |
| Epoxy/Novolac (1) | 94 | 130 | 149 | 168 | 180 | 2.31 |

G.I. is the grinding index using Ex.1 as the comparison base. This figure should be treated with caution in this Table since the runs were not performed at the same time on steel from the same batch. There is an inherent experimental variability therefore and the results should be used primarily to compare performance of the listed additives within the group.

(1) In each case the formulation contained the same proportions of the major components but added dispersants, (sodium xylene sulfonate, and Dowfax 2A1, which is available from Dow Chemical Co.) were used in each second run. As can be seen, the added dispersants, were much more helpful when added to the epoxy/novolac formulations than when added to the phenolic/melamine formulations.

It is noted that all the products evaluated in the above runs were substantially better than the un-supersized product evaluated in Example 1.

EXAMPLE 4

This Example illustrates the use of a number of other alternative grinding aids in formulations according to the invention. The additives used were:

A. Rez-0-Sperse A-1, which is an aqueous dispersion of Chlorez-700, available from Dover Chemical Corp. under that trade name.

B. Decabromodiphenyl oxide.

C. Hexabromocyclododecane.

D. Pyrochek-68PBG a polymer of polybrominated styrene available from Ferro Corp.

E. FR-105, pentabromotoluene available from Ameribrom Corp.

F. BT-93, Ethylene,bis(tetrabromophthalimide) available from Ethyl Chemicals. [Comp. $KBF_4$ in the epoxy formulation described in Example 2.]

Additives A through F were formulated with the epoxy/novolac resin described in Example 2 so as to give a formulation containing about 25% of the grinding aid and having a viscosity between 2000 and 6000 cps.

The formulations containing B through F and "Comp" all had the combination of sodium xylene sulfonate and Dowfax 2A1 dispersants described above.

The formulations were each evaluated as supersizes in the same manner described above and the results obtained are set out in Table 4 below.

TABLE 4

| Formulation (Additive) | Metal cut in Mins. Indicated (gms) 4 | 8 | 12 | 16 | 20 | G.I. |
|---|---|---|---|---|---|---|
| A | 100 | 162 | 204 | 229 | 250 | 3.21 |
| B | 76 | 101 | 119 | 133 | 149 | 1.91 |
| C | 98 | 145 | 173 | 195 | 211 | 2.71 |
| D | 62 | 80 | 95 | 107 | 120 | 1.54 |
| E | 60 | 78 | 92 | 107 | 120 | 1.54 |
| F | 64 | 85 | 99 | 114 | 126 | 1.62 |
| Comp. | 51 | 72 | 87 | 102 | 117 | 1.50 |

G.I. was calculated using the Example 1 result as the base. See comments from Example 3 on the use of this information.

As with the previously illustrated formulations according to the invention, the coated abrasives having the above supersize formulations were clearly superior to the conventional $KBF_4$ formulations, and sustained that improvement over a prolonged period of grinding.

EXAMPLE 5

This Example illustrates the use of a formulation comprising chlorendic anhydride as the grinding aid. This compound, which is available from Velsicol Corp., is based on chlorinated bicycloheptene and has an anhydride group that makes it susceptible to reaction with phenolic or epoxy resin systems. For this reason the binder selected was a commercial copolymer of vinylidene chloride, acrylonitrile and an acrylate monomer available from W. R. Grace and Co. under the trade name SL-112.

The formulation according to the invention, (expressed in gm), was as follows:

| | |
|---|---|
| SL-112 | 400 (solids content 50%) |
| Water | 500 |
| Ammonia | 30 |
| BYK 118 (Dispersant) | 30 |
| BYK 156 (Dispersant) | 20 |
| Dowfax 2A1 (Surfactant) | 100 |
| Daxad-11 (Dispersant) | 20 |
| E-5260 (Red dye) | 40 |
| Nalco 2311 (Antifoam) | 10 |
| Chlorendic Anhydride | 650 |

The BYK dispersants are available from BYK Chemie USA. Dowfax 2A1 is a di-sodium sulfonate of di-phenyl oxide surfactant available from Dow Chemical Co. Dexad-11 is available from W. R. Grace Co. Nalco 2311 is available from Nalco Co.

The viscosity of the above formulation was in the desired 2000–6000 cps range and the grinding aid represents about 76% of the combined solids weight of the binder and the grinding aid. The cumulative cut after 20 minutes of grinding in the standard test described above was taken for a product using the above formulation as a supersize and for a product in which the grinding aid in the formulation is replaced with an equal amount of $KBF_4$.

With the formulation according to the invention the cumulative cut was 152 gm whereas with the $KBF_4$ grinding aid the cumulative cut was only 104 gm.

EXAMPLE 6

This Example details the "Grinding Index", calculated as described above, for a number of grinding aids. The same substrate and binder were used in each, with 36 grit abrasive particles except where indicated. The results are set out in Table 5 below.

TABLE 5

| Grinding Aid | G I.* |
|---|---|
| Pentabromobenzyl acrylate (oligomer) (Ameribrom) | 1.63 |
| Med. M. Wt. poly. of brominated styrene (Ferro Corp) (80% wt. loss at 450° C.) | 1.54 |
| Ethylenebis tetrabromo-phthalimide (Ethyl Corp) | 1.62 |
| Pentabromotoluene (Ameribrom) | 2.24 |
| Chlorendic Anhydride (Velsicol) | 2.45 (1) |
| Hexabromocyclododecane (Great Lakes Chem. Co.) | 2.71 |
| Decabromodiphenyl oxide (Ethyl Corp.) (M. Pt. 300° C., 50% wt. loss at 414° C.) | 2.01 |
| Dechlorane Plus* (Occidental Chem. Co.) (M. Pt. 350° C., 20% decomposed at this temp.) | 2.49 (2) |
| Chlorez 700 (and 760) (Dover Chem.) | 2.64 |
| ($KBF_4$ | 1.83) |

*Dodecachloro, dodecahydro-dimethano dibenzo cyclooctene.
(1) grit size 50;
(2) grit size 40
**See earlier comments on use of G.I. figures. These values were calculated in series of evaluations corresponding to those described in the above Examples.

What is claimed is:

1. A grinding aid formulation comprising a water-insoluble, halogenated hydrocarbon grinding aid, having a halogen content of at least 50 wt. %, which is thermally stable up to about 400° C. but is thermally unstable at about 600° C., and a polymeric binder curing to a coherent film; said formulation: a) containing at least 50 wt. % of the grinding aid, based on the combined solids weight of the binder and the grinding aid, b) having a viscosity at 25° C. of from 1000 to 12000 cps, and c) having a grinding quotient of at least 1.5.

2. A formulation according to claim 1 in which the halogenated hydrocarbon has a halogen content of at least 60 wt. %.

3. A formulation according to claim 1 in which the polymeric binder is selected from the group consisting of phenolic and epoxy resins.

4. A formulation according to claim 1 in which the viscosity is from 2000 to 6000 cps.

5. A formulation according to claim 1 in which the halogenated hydrocarbon is a chlorinated paraffin hydrocarbon with a molecular weight of from 600 to 1000 and a halogen content of at least 60 wt. % .

6. A formulation according to claim 1 in which the halogenated hydrocarbon is a polymer.

7. A formulation according to claim 6 in which the polymer is selected from the group consisting of polybromostyrene and a coplymer of vinylidene chloride, acrylonitrile and an acrylate monomer.

8. A formulation according to claim 1 in which the grinding aid represents at least 70 wt. % of the combined solids weight of the grinding aid and the binder.

9. A formulation according to claim 1 in which the halogenated hydrocarbon is selected from the group consisting of pentabromotoluene; chlorendic anhydride; hexabromocyclododecane; dodecachloro dodecahydro dimethano dibenzo cyclooctene; and chlorinated $C_{20}$ to $C_{30}$ hydrocarbons.

10. A formulation according to claim 1 in which the halogenated hydrocarbon selected undergoes more than 20% weight loss when heated at a temperature of 600° C.

11. A formulation according to claim 10 in which the halogenated hydrocarbon loses more than 20% of its weight when heated at 500° C.

12. A grinding aid formulation comprising a water-insoluble halogenated hydrocarbon having a halogen content of greater than about 60 wt. % which is thermally stable up to at least 400° C. but begins to lose weight at below 600° C. and which loses at least 80% of its weight when heated to 700° C.; and a polymeric binder curing to a coherent film and selected from epoxy resins and phenolic resins, the proportions of the components being such that the formulation has a viscosity at 25° C. of from 2,000 to 6,000 cps, the halogenated hydrocarbon comprises at least 60 wt. % of the formulation solids, and the formulation has a grinding index of at least 2.

13. A formulation according to claim 12 in which the halogenated hydrocarbon is selected from the group consisting of pentabromotoluene; chlorendic anhydride; hexabromocyclododecane; dodecachloro dodecahydro dimethano dibenzo cyclooctene; and chlorinated $C_{20}$ to $C_{30}$ hydrocarbons.

* * * * *